US006988541B2

(12) United States Patent
Nakajima et al.

(10) Patent No.: US 6,988,541 B2
(45) Date of Patent: Jan. 24, 2006

(54) OIL-COOLER-EQUIPPED RADIATOR

(75) Inventors: Shiro Nakajima, Tokyo (JP); Satoshi Kimura, Tokyo (JP); Kenji Tochigi, Tokyo (JP); Hiroyuki Okura, Tokyo (JP); Shinichi Miyasaka, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 11/005,478

(22) Filed: Dec. 7, 2004

(65) Prior Publication Data

US 2005/0173099 A1 Aug. 11, 2005

(30) Foreign Application Priority Data

Dec. 8, 2003 (JP) ..... 2003-409279

(51) Int. Cl.
*F28F 9/02* (2006.01)

(52) U.S. Cl. ..... 165/140; 165/76; 165/916; 29/890.039; 29/890.054

(58) Field of Classification Search ..... 165/76, 165/140, 916; 29/890.039, 890.054
See application file for complete search history.

(56) References Cited

U.S. PATENT DOCUMENTS 4,227,570 A * 10/1980 Crews ..... 165/140
5,113,930 A * 5/1992 Le Gauyer ..... 165/140
5,151,157 A * 9/1992 Le Gauyer ..... 165/140

FOREIGN PATENT DOCUMENTS

JP 10-073393 A 3/1998
JP 2001-153586 A 6/2001

* cited by examiner

*Primary Examiner*—Leonard R. Leo
(74) *Attorney, Agent, or Firm*—Foley & Lardner LLP

(57) ABSTRACT

An oil cooler is held by holding plates. Top portions of side pieces of each holding plate are disposed through a side wall of a tank and are bent at the outer surface of the tank, so that circular interposed members and the oil cooler are retained by being sandwiched between middle supporter pieces of the holding plates and the side wall of the tank in the stacking direction of element units such that the oil cooler is movable in the longitudinal direction with respect to the side wall of the tank. By inserting connecting pipes of the oil cooler through openings of the tank so as to temporarily assemble the connecting pipes into openings of a tube plate, blocking flanges of the connecting pipes are retained while being in contact with the outer surface of the side wall of the tank.

3 Claims, 13 Drawing Sheets

OIL-COOLER-EQUIPPED RADIATOR

BACKGROUND OF THE INVENTION

1. Field of the Invention

The present invention relates to an oil-cooler-equipped radiator in which an oil cooler is fixed in a radiator by brazing while the oil cooler is accommodated in a tank of the radiator for a motor vehicle, and others.

2. Description of the Related Art

Hitherto, techniques about an oil-cooler-equipped radiator in which an oil cooler is accommodated in a tank of the radiator have been known. Examples of such oil-cooler-equipped radiators are disclosed in Japanese Patent Applications Laid-open No. 2001-153586 and No. Hei 10-73393.

Also, an all-aluminum radiator in which the tank and core part of the radiator are made of aluminum has been developed in recent years. In this type of radiator, brazing of an oil cooler and a tank of the radiator is performed while the oil cooler made of aluminum is accommodated in the tank.

Referring to FIG. 11, when a conventional oil cooler is to be brazed alone, a plurality of plates 102 are pressed toward the center of the stacking direction (in the directions indicated by the arrows in FIG. 11) by using platy jigs 101. In this way, the oil cooler 103 is temporarily assembled, with no gaps existing between the components thereof, and then the oil cooler 103 is brazed in a heating furnace, not shown.

However, in order to perform brazing of the oil cooler and a tank of the radiator while the oil cooler is accommodated in the tank, jigs for temporarily assembling the oil cooler and the tank are necessary in addition to the platy jigs 101 shown in FIG. 11. Further, these jigs must be removed from the radiator and the oil cooler after the brazing.

Also, in the above-described known art, a brazing process is performed in a state where both oil connecting pipes of the oil cooler, which are disposed through holes in the side wall of the tank of the radiator, are fixed to the side wall of the tank of the radiator, whereby the following problems to be solved arise.

That is, as it is difficult to evenly transfer heat to the oil cooler in the tank during a brazing process, the temperature difference between the side wall of the tank and the oil cooler inside the tank causes a difference in thermal expansion therebetween. As a result, deformation may occur in the oil cooler and/or the side wall of the tank, or brazing failure may occur disadvantageously.

If a time period of brazing in a heating furnace is extended to decrease the temperature difference, zinc diffusion in a radiator tube proceeds while degrading the corrosion resistance of the radiator tube, which is unfavorable.

The present invention has been made in view of the above-described problems, and it is an object of the present invention to provide an oil-cooler-equipped radiator in which an oil cooler can be heat-treated together with the radiator while the oil cooler is accommodated in a tank of the radiator so that each component of the oil cooler can be brazed at the same time, without performing a troublesome operation of removing jigs used for temporary assembling and without causing deformation of each member due to heat treatment or brazing failure.

SUMMARY OF THE INVENTION

According to a first aspect of the present invention there is provided an oil-cooler-equipped radiator comprising: a radiator; a tank provided in the radiator; and an cooler that is accommodated in the tank of the radiator and that has a heat exchanger, the heat exchanger a plurality of stacked element units that communicate with each other, a pair of fixed tube plates that are in communication with the outermost element units of the heat exchanger, and a pair of connecting pipes that are disposed through corresponding openings in a side wall of the tank and through corresponding openings in both end portions in the longitudinal direction of one of the tube plates, wherein each of the connecting pipes is formed with a blocking flange that is wide enough to block the corresponding opening of the tank and that is disposed on an outer surface of the corresponding connecting pipe at a mid portion of the corresponding connecting pipe such that the blocking flange is in contact with the outer surface of the side wall of the tank, wherein the width of each opening in the side wall of the tank is larger than at least the outer diameter of the corresponding connecting pipe in the longitudinal direction of the oil cooler, wherein, before brazing the oil-cooler-equipped radiator, which is brazed while the oil cooler is accommodated in the tank of the radiator in a state in which respective circular interposed members are corresponding disposed between outer edge portions of the openings of the tube plate and inner edge portions of the openings of the tank, the connecting pipes are inserted through the corresponding openings of the tank so as to temporarily assemble the connecting pipes in the corresponding openings of the tube plate, so that both of the blocking flanges are retained while being in contact with the outer surface of the side wall of the tank and the oil cooler is held by holding plates each having bent portions so as to have a substantially U-shaped cross-section, and wherein top portions of side pieces of each holding plate are disposed through the side wall of the tank and are bent, so that the oil cooler is retained by being sandwiched between middle supporter pieces of the respective holding plates and the side wall of the tank in the stacking direction of the element units while being movable in the longitudinal direction of the oil cooler with respect to the side wall of the tank.

The oil-cooler-equipped radiator has the above-described configuration. That is, the oil cooler, which includes the heat exchanger including the plurality of stacked element units communicating with each other; and the pair of tube plates fixed such that the tube plates are in communication with the outermost element units of the heat exchanger, is held by the holding plates, each having bent portions so as to have a substantially U-shaped cross section. Since the top portions of the both side pieces of each holding plate are disposed through the side wall of the tank and are bent at the outer surface of the tank, each circular interposed member and the oil cooler are retained by being sandwiched between the middle supporter pieces of the holding plates and the side wall of the tank in the stacking direction of the element units, while the oil cooler being movable in the longitudinal direction with respect to the side wall of the tank. Further, by inserting the connecting pipes of the oil cooler through the openings of the tank so as to temporarily assemble the connecting pipes to the openings of the tube plate, both blocking flanges are kept in contact with the outer surface of the side wall of the tank.

With this configuration, in a state where the oil cooler is accommodated in the tank of the radiator, the oil cooler is heat-treated together with the radiator, so that each component of the oil cooler can be brazed at the same time.

Also, by using the holding plates, which are incorporated together with the oil cooler into the tank of the radiator, jigs for temporarily assembling the oil cooler and those for temporarily attaching the oil cooler to the radiator are not required. Therefore, an operation of removing the jigs need not be performed. The radiator can be assembled and transferred while the temporarily-assembled oil cooler is accommodated in the tank, and the oil cooler and the radiator can be brazed together.

Accordingly, time and trouble required for temporarily assembling and brazing the oil-cooler-equipped radiator can be significantly reduced.

In addition, the width of each opening in the side wall of the tank is wider than at least the outer diameter of each of the connecting pipes in the longitudinal direction of the oil cooler. Also, since the top portions of the both side pieces of each holding plate are disposed through the side wall of the tank and are bent at the outer surface of the tank, each circular interposed member and the oil cooler are sandwiched between the middle supporter pieces of the holding plates and the side wall of the tank in the stacking direction of the element units, while the oil cooler being movable in the longitudinal direction with respect to the side wall of the tank. With this configuration, the connecting pipes can relatively move freely at least in the longitudinal direction of the oil cooler within the range of the large openings in the side wall of the tank, with respect to the side wall of the tank. Therefore, thermal stress can be absorbed even if heat is hard to be transferred evenly to the oil cooler in the tank during a brazing process, causing difference in thermal expansion due to the temperature difference between the side wall of the tank and the oil cooler inside the tank.

Consequently, deformation of the oil cooler and/or a member such as the side wall of the tank caused by heat treatment and occurrence of brazing failure can be prevented.

According to a second aspect of the present invention there is provided a method of forming an oil-cooler-equipped radiator which is brazed while an oil cooler is accommodated in a tank of the radiator, the oil cooler being equipped with a heat exchanger that includes a plurality of stacked element units that communicate with each other; a pair of fixed tube plates that are in communication with the outermost element units of the heat exchanger; and a pair of connecting pipes that are disposed through corresponding openings in a side wall of the tank and through corresponding openings in both end portions in the longitudinal direction of one of the tube plates, the method comprising: forming the width of each opening in the side wall of the tank to be larger than at least the outer diameter of the corresponding connecting pipe in the longitudinal direction of the oil cooler; forming corresponding blocking flanges, each of which is wide enough to block the corresponding opening of the tank, on an outer surface of the corresponding connecting pipe at a mid portion of the corresponding connecting pipe such that the blocking flange is in contact with the outer surface of the side wall of the tank; inserting the connecting pipes into the corresponding openings of the tank so as to temporarily assemble the connecting pipes in the corresponding openings of the tube plate so that both of the blocking flanges are retained while being in contact with the outer surface of the side wall of the tank; holding the oil cooler with holding plates each having bent portions so as to have a substantially U-shaped cross-section; disposing top portions of side pieces of each holding plate through the side wall of the tank; bending the top portions so that the oil cooler is retained by being sandwiched between middle supporter pieces of the respective holding plates and the side wall of the tank in the stacking direction of the element units while being movable in the longitudinal direction of the oil cooler with respect to the side wall of the tank, and brazing the oil cooler and the tank in a state in which respective circular interposed members are correspondingly disposed between outer edge portions of the openings of the tube plate and inner edge portions of the openings of the tank.

This method brings the same advantaged as those of the above oil-cooler-equipped radiator.

BRIEF DESCRIPTION OF THE DRAWINGS

The objects, features and advantages of the present invention will become apparent as the description proceeds when taken in conjunction with the accompanying drawings, in which.

DETAILED DESCRIPTION OF THE PREFERRED EMBODIMENTS

Hereinafter, oil-cooler-equipped radiators according to embodiments of the present invention will be described.

Figure 1:
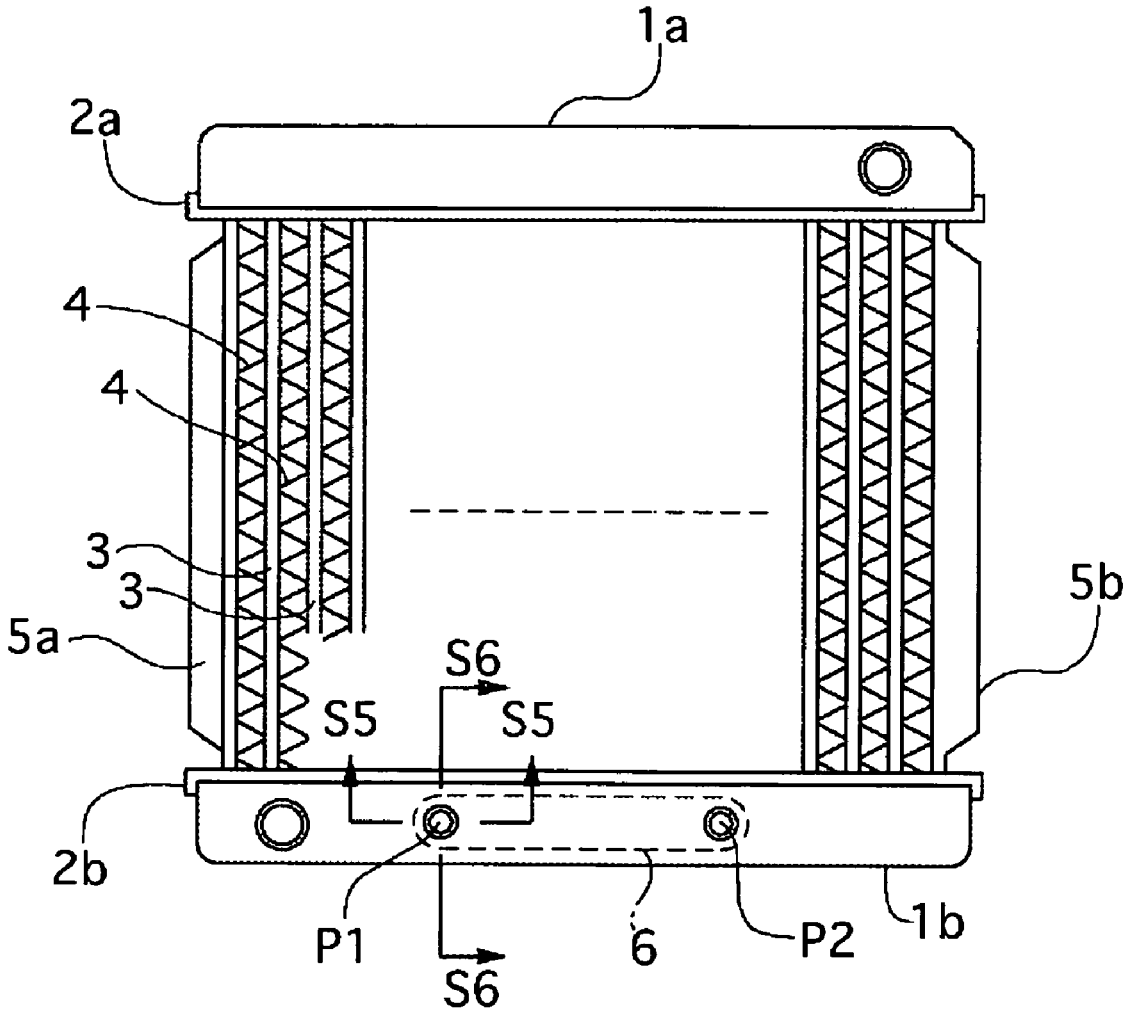
FIG. 1 shows an entire oil-cooler-equipped radiator according to an embodiment of the present invention.

As shown in FIG. 1, the oil-cooler-equipped radiator of the embodiment includes: a pair of seat plates 2*a* and 2*b* provided with tanks 1*a* and 1*b*, respectively; tubes 3 and corrugated fins 4 disposed between the seat plates 2*a* and 2*b*; and reinforcements 5*a* and 5*b* for connecting both end portions of the seat plates 2*a* and 2*b* so as to mechanically reinforce the seat plates 2*a* and 2*b*.

An oil cooler 6 is accommodated in the tank 1*b*. All the components including the oil cooler 6 are made of aluminum. Hereinafter, the configuration of the oil cooler 6 will be described in detail.

Figure 2A:
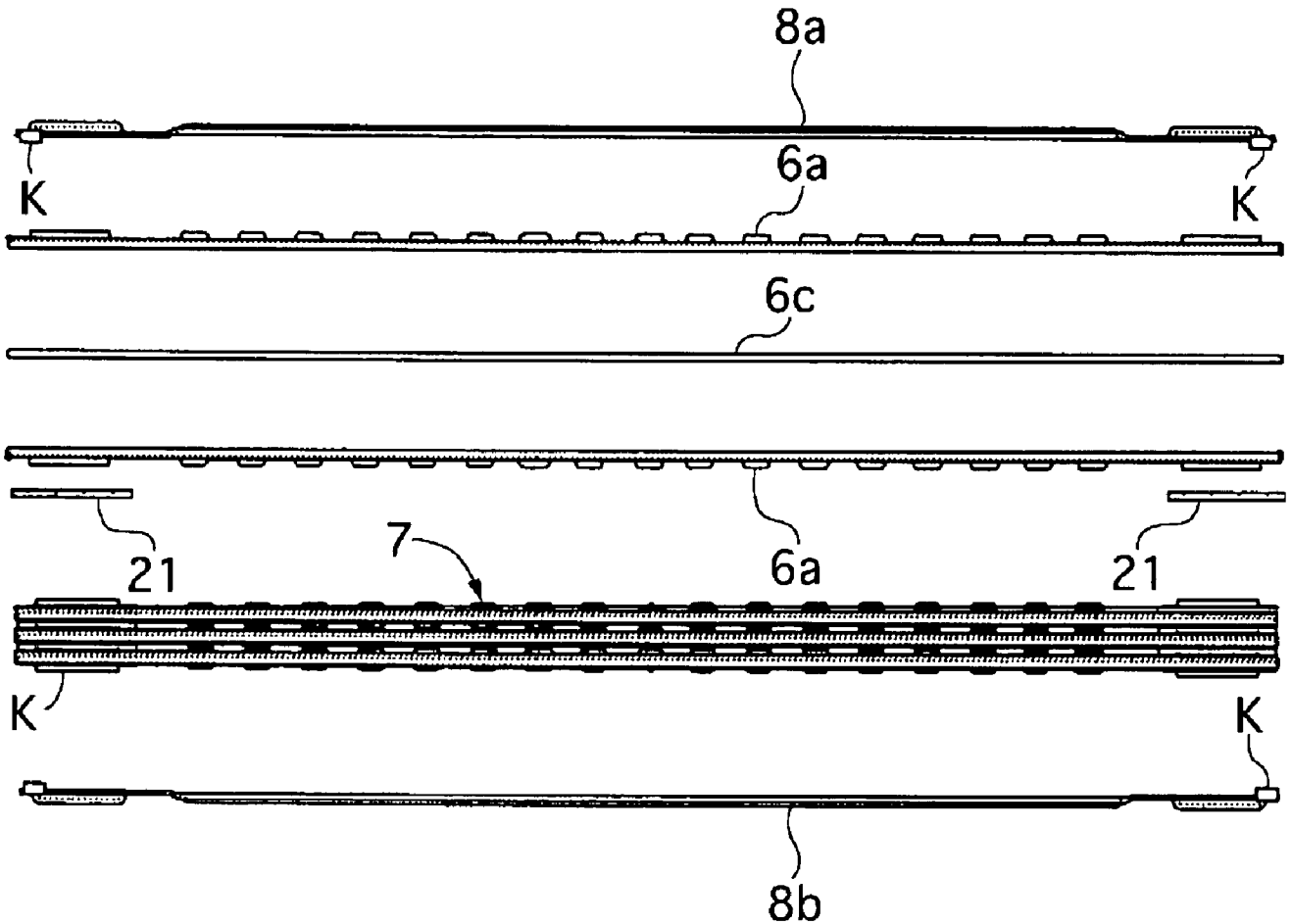
FIGS. 2A and 2B are exploded views of main parts of the oil cooler according to the embodiment shown in FIG. 1.
Figure 2B:
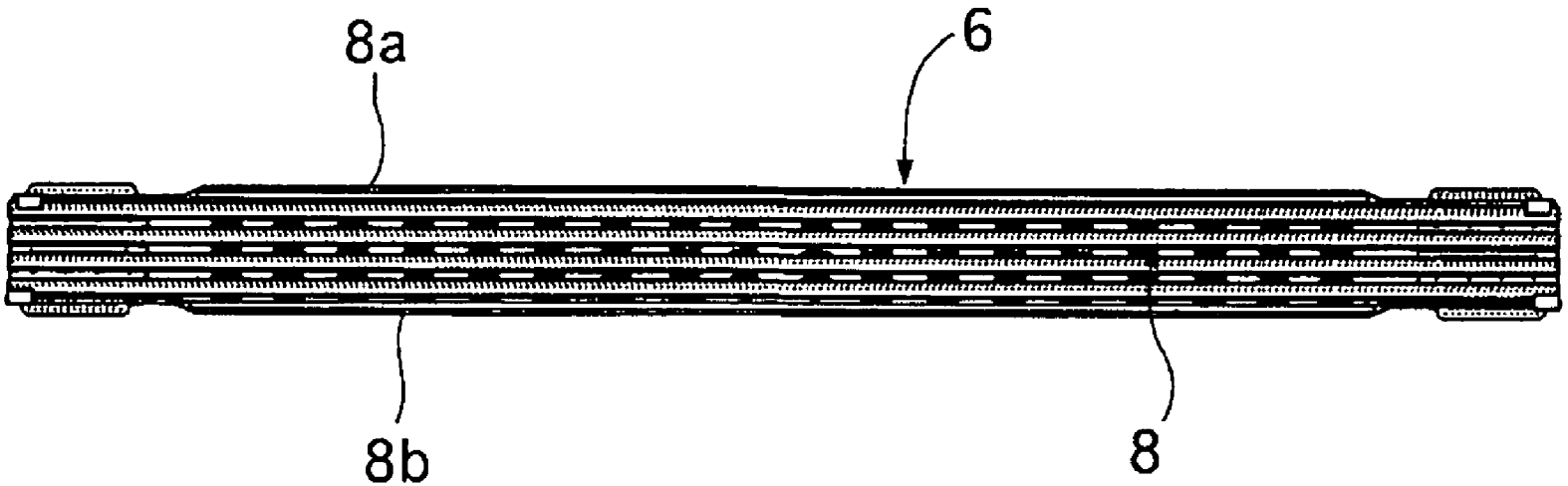
Figure 3:
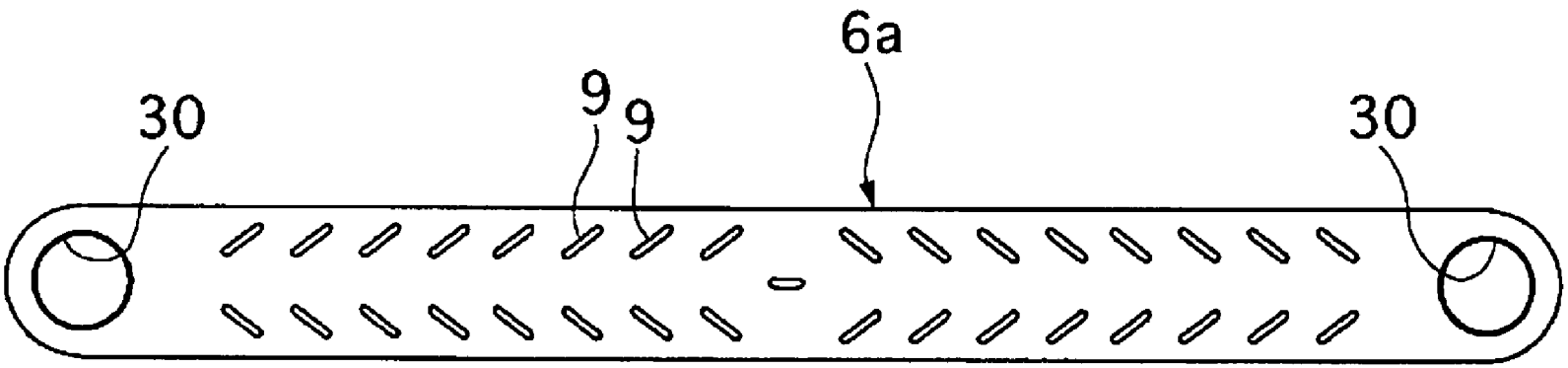
FIG. 3 is a plan view of a shell of the oil cooler according to the embodiment shown in FIG. 1.

As shown in FIGS. 2A, 2B, and 3, the oil cooler 6 includes a heat exchanger 8, which includes a plurality of (in the embodiment, four layers of) element units 7 stacked one on another via sheets 21. Each element unit 7 includes a pair of shells 6*a*, the periphery thereof being raised so as to form a dish shape and both end portions thereof having an opening 30, and the pair of shells 6*a* are engaged with each other with a corrugated inner fin 6*c* therebetween. Each shell 6*a* is provided with blades 9 for diffusing oil.

Tube plates 8*a* and 8*b* are fixedly stacked on the outermost element units 7 on both sides in the stacking direction. The tube plates 8*a* and 8*b* are fixed to the outermost element units 7, respectively, by being caulked at caulking portions K.

Figure 4:
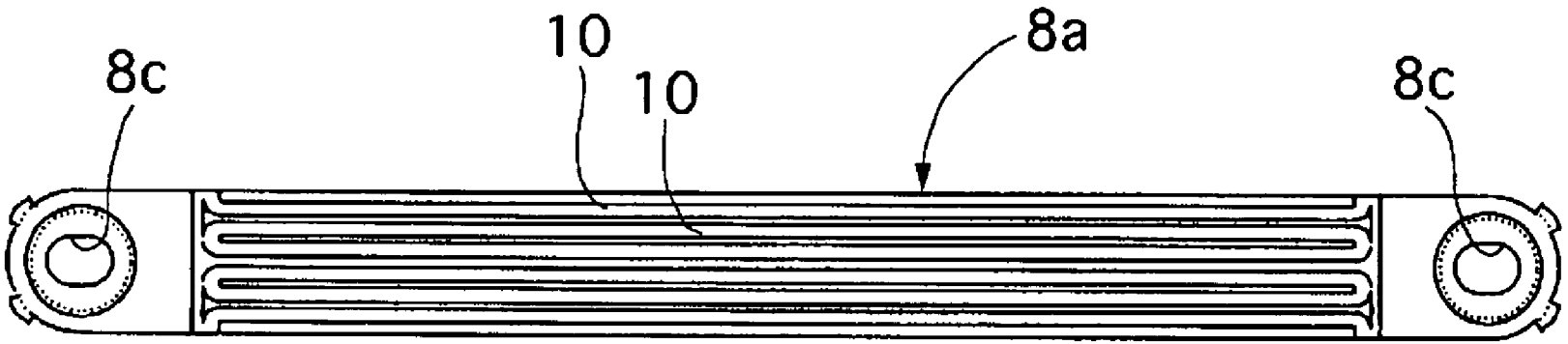
FIG. 4 is a plan view of a tube plate of the oil cooler according to the embodiment shown in FIG. 1.

Also, as shown in FIG. 4, openings 8*c* are disposed at both end portions of the tube plate 8*a*. Connecting pipes P1 and P2 (FIG. 1) are inserted through the openings 8*c* so as to be connected. The tube plate 8*a* also has guide grooves 10 for allowing oil to flow in the longitudinal direction of the oil cooler 6. The connecting pipes P1 and P2 will later be described in detail.

At each contact part between the components of the oil cooler 6, a waxed brazing sheet, as cladding material, is used in at least one side thereof.

Figure 5:
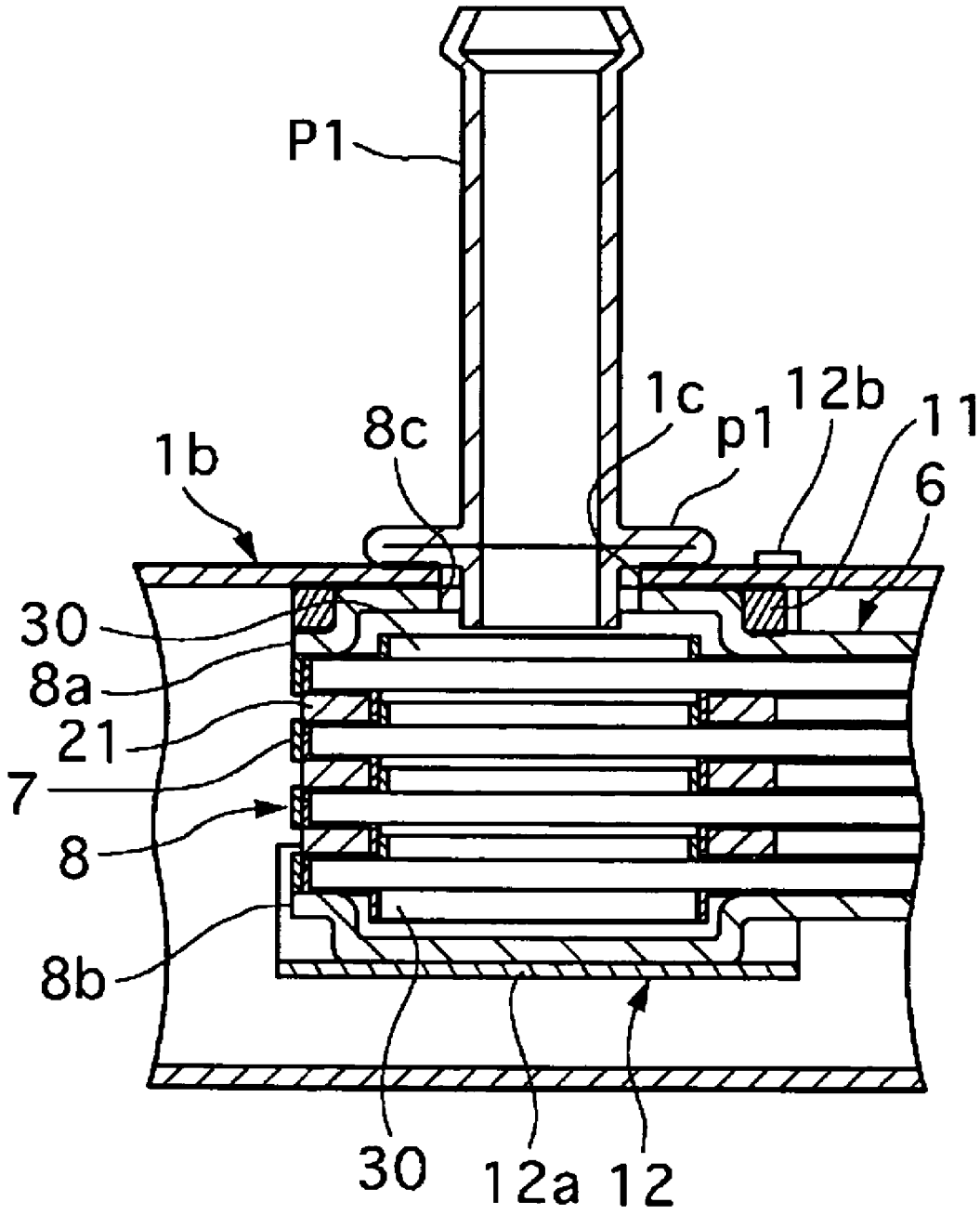
FIG. 5 is a cross-sectional view taken along the line S5—S5 in FIG. 1.
Figure 6:
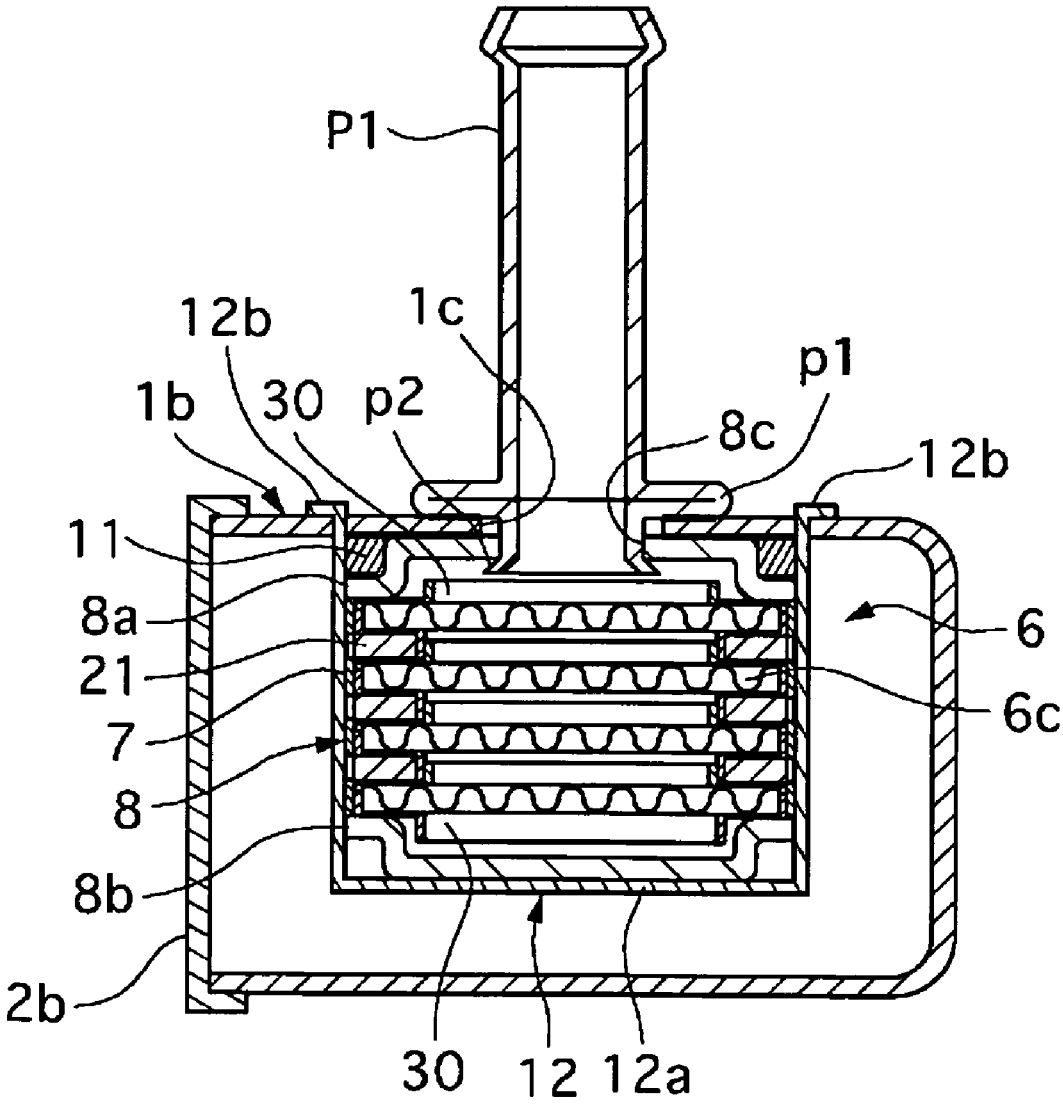
FIG. 6 is a cross-sectional view taken along the line S6—S6 in FIG. 1.

The oil cooler 6 having the above-described configuration is placed at a predetermined position in the tank 1*b*, with a circular interposed member 11 (FIG. 5) disposed between the outer edge portion of each of the openings 8*c* of the tube plate 8*a* and an inner edge portion of each opening 1*c* of the tank 1*b*, as shown in FIGS. 1, 5, and 6. Accordingly, the oil cooler 6 is assembled such that the connecting pipes P1 and P2 outwardly protrude through both openings 1*c* in the side wall of the tank 1*b*.

The oil cooler 6 functions as a cooling circuit, in which oil for the engine or automatic transmission (AT) flows from the connecting pipe P1 through the element units 7 of the heat exchanger 8 in the longitudinal direction thereof, so that the heat exchange between the oil and cooling water in the tank 1*b* is carried out. Thereafter, the oil is discharged from the connecting pipe P2.

Further, a blocking flange p1 is integrally formed in each of the connecting pipes P1 and P2. The blocking flange p1 is positioned at a mid portion near the inserted side on the outer surface of the connecting pipe P1, while being in contact with the outer surface of the side wall of the tank 1*b*, and is wide enough to block the opening 1*c*. Also, diametrically opposed anchoring portions p2 project from the outer surface of each connecting pipe at the inserted-side end thereof. By engaging the anchoring portions p2 with each of the openings 8*c* of the tube plate 8*a*, the connecting pipes P1 and P2 are temporarily attached. For this purpose, the openings 8*c* of the tube plate 8*a* are longer in the longitudinal direction of the tube plate 8*a* so that the anchoring portions p2 can pass therethrough.

Also, the width of each opening 1*c* in the side wall of the tank 1*b* is larger than at least the outer diameter of each of the connecting pipes P1 and P2 in the longitudinal direction of the oil cooler 6.

In the blocking flange p1 and the circular interposed member 11, a waxed brazing sheet, as cladding material, is used in at least one side thereof at each contact portion, as in the oil cooler 6.

Further, in the blocking flange p1 and the circular interposed member 11, the parts indicated with thick lines in FIGS. 5 and 6 are brazed and fixed in a heat treating furnace, which will be described later.

Next, temporary assembling of the oil cooler 6, having the above-described configuration, into the tank 1*b* will be described. Since both end portions of the oil cooler 6 are symmetrically formed in the longitudinal direction, only the side of the connecting pipe P1 is described.

The oil cooler 6 is temporarily attached to the side wall of the tank 1*b*, having the opening 1*c*, by using a holding plate 12.

Figure 7:
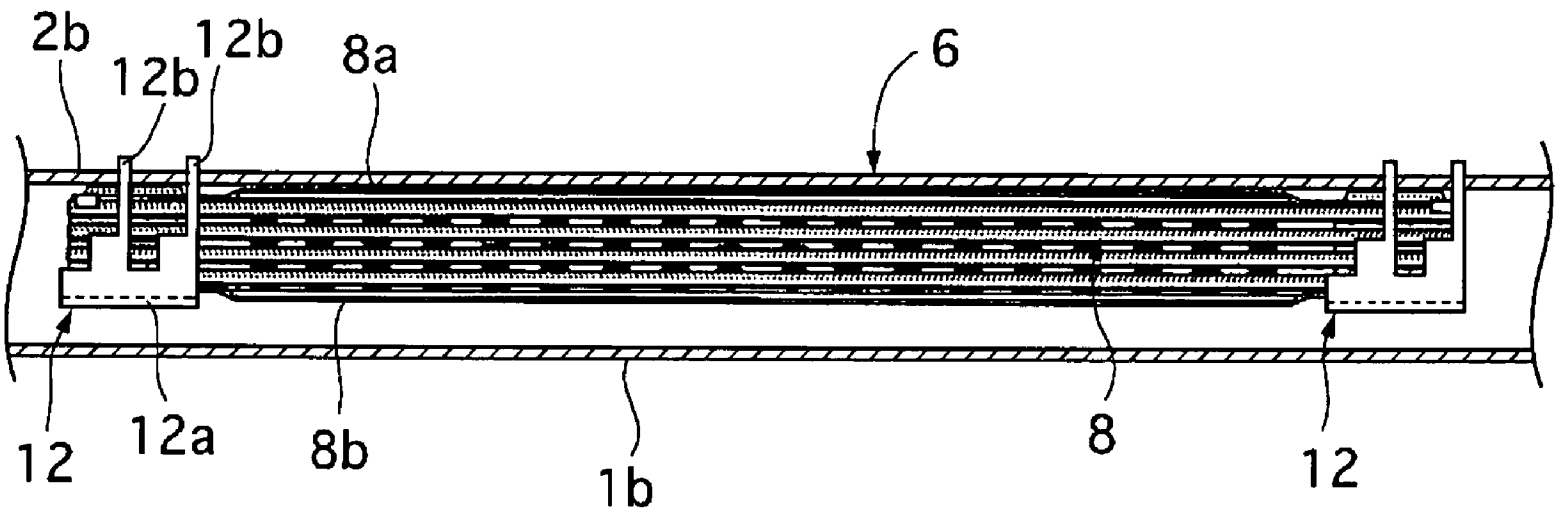
FIG. 7 shows the oil cooler in a temporarily-assembled state.

More specifically, as shown in FIGS. 5 to 7, the holding plate 12 is composed of a middle supporter piece 12*a*, which is in contact with the outer surface of the tube plate 8*b* so as to support it, and two side pieces 12*b* extending in parallel along both side faces of the oil cooler 6 from both ends of the middle supporter piece 12*a*, so that the holding plate 12 has a substantially U-shaped cross section. The oil cooler 6 is held by this holding plate 12. Furthermore, since the top portions of both side pieces 12*b* of the holding plate 12 are disposed through the side wall of the tank 1*b* and are bent at the outer surface of the tank 1*b*, the oil cooler 6 is retained by being sandwiched between the middle supporter piece 12*a* of the holding plate 12 and the side wall of the tank 1*b* in the stacking direction of the element units 7. Accordingly, the oil cooler 6 is temporarily attached to the side wall of the tank 1*b* such that the oil cooler 6 is movable in the longitudinal direction with respect to the side wall of the tank 1*b*.

Figure 8A:
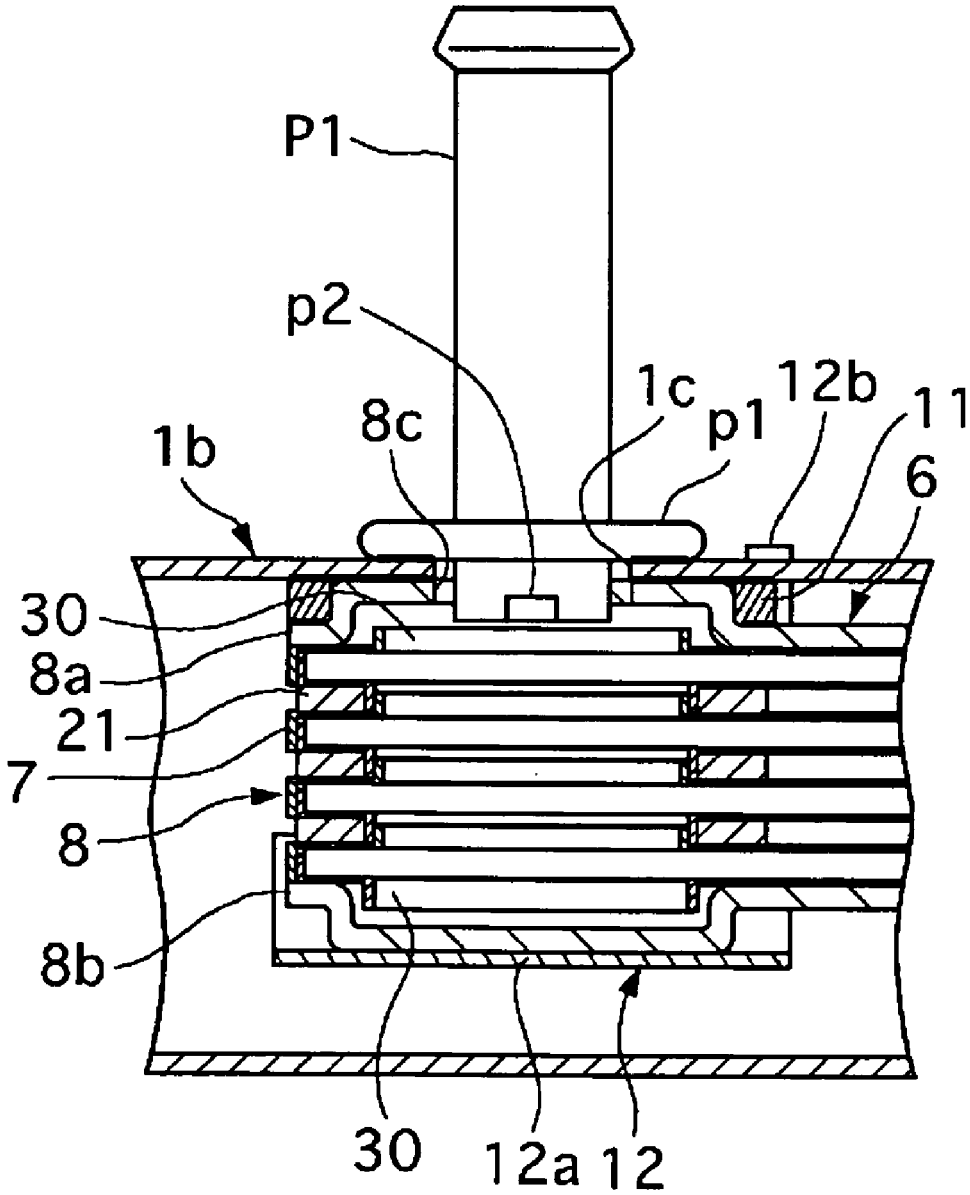
FIGS. 8A and 8B illustrate a quick-fit method according to the embodiment shown in FIG. 1.
Figure 8B:
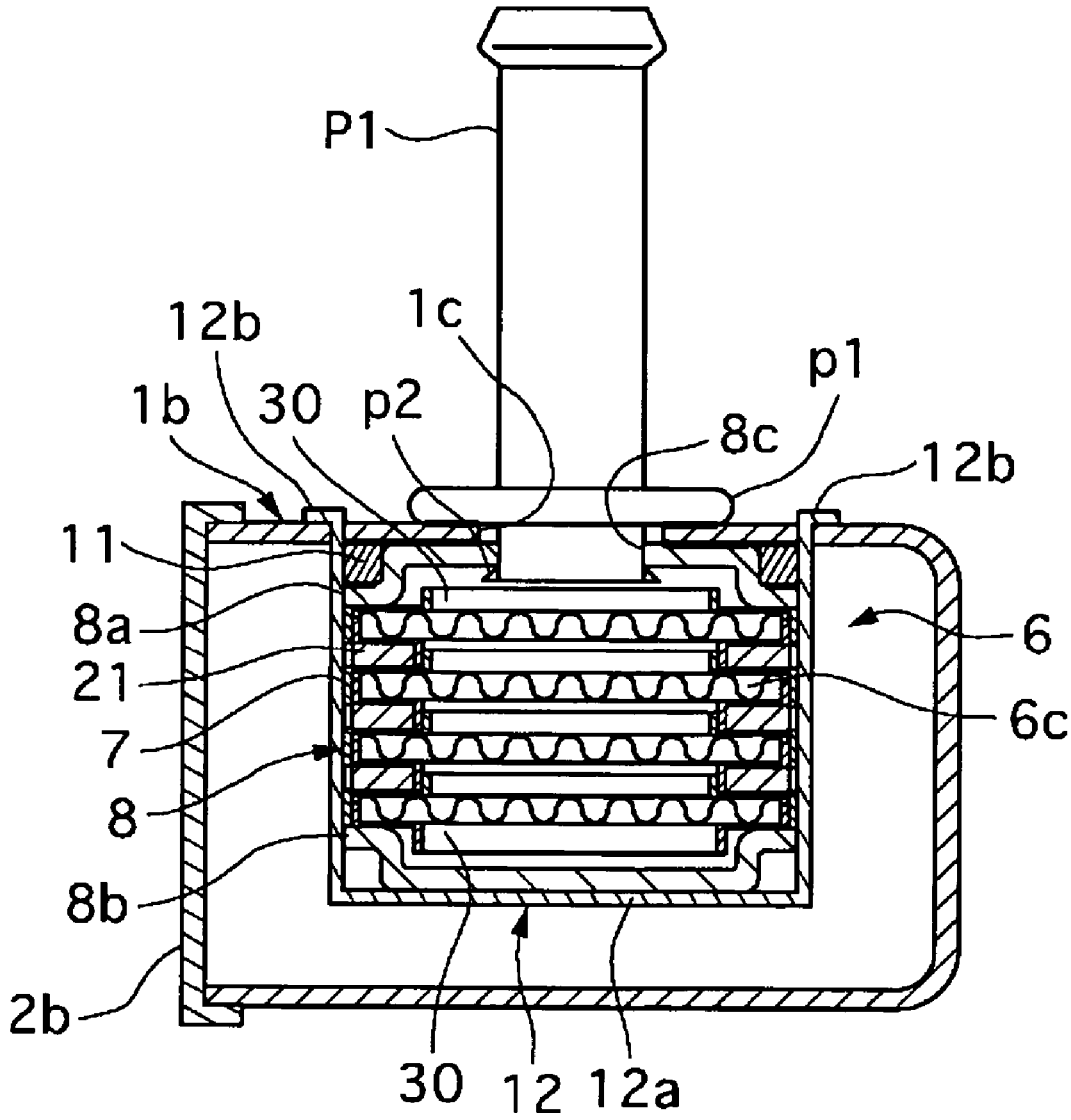

Next, temporary assembling of the connecting pipes P1 and P2 into the tank 1*b* and the oil cooler 6 will be described with reference to FIGS. 8A and 8B. Since both end portions of the oil cooler 6 are symmetrically formed in the longitudinal direction, only the side of the connecting pipe P1 is described.

In the embodiment, the connecting pipe P1 is fixed by a quick-fit method. Specifically, the connecting pipe P1 is inserted through the opening 8*c* in the direction from the upper side toward the lower side of FIG. 8A such that the both anchoring portions p2 are directed in the major-axis direction of the oval opening 8*c* of the tube plate 8*a*. Then, by rotating the connecting pipe P1 about the axis in the clockwise direction or in the counterclockwise direction in FIG. 8B, the anchoring portions p2 are engaged with the opening 8*c* of the tube plate 8*a* such that the blocking flange p1 of the connecting pipe P1 is in contact with the outer surface of the side wall of the tank 1*b* so as to block the opening 1*c*. Accordingly, the connecting pipe P1 is temporarily assembled into the tank 1*b* and the oil cooler 6.

Then, in a state where the oil cooler 6 is accommodated in the tank 1*b*, the temporarily-assembled oil-cooler-equipped radiator is transferred into a heat treating furnace, not shown, and is heat-treated, so that each contact part of the components is brazed and the components are integrated.

Next, the operations and effects of the oil-cooler-equipped radiator according to the embodiment will be described.

In the oil-cooler-equipped radiator of the embodiment, the oil cooler 6, which includes the heat exchanger 8 including the plurality of stacked element units 7 communicating with each other; and the pair of tube plates 8*a* and 8*b* fixed such that the tube plates are in communication with the outermost element units 7 of the heat exchanger 8, is held by the holding plates 12, each having bent portions so as to have a substantially U-shaped cross section. Since the top portions of the both side pieces 12*b* of each holding plate 12 are disposed through the side wall of the tank 1*b* and are bent at the outer surface of the tank 1*b*, each circular interposed member 11 and the oil cooler 6 are retained by being sandwiched between the middle supporter pieces 12*a* of the holding plates 12 and the side wall of the tank 1*b* in the stacking direction of the element units 7, while the oil cooler 6 being movable in the longitudinal direction with respect to the side wall of the tank 1*b*. Further, by inserting the connecting pipes P1 and P2 of the oil cooler 6 through the openings 1*c* of the tank 1*b* so as to temporarily assemble the connecting pipes P1 and P2 to the openings 8*c* of the tube plate 8*a*, both blocking flanges p1 are kept in contact with the outer surface of the side wall of the tank 1*b*.

With this configuration, in a state where the oil cooler 6 is accommodated in the tank 1*b* of the radiator, the oil cooler 6 is heat-treated together with the radiator, so that each component of the oil cooler 6 can be brazed at the same time.

Also, by using the holding plates 12, which are incorporated together with the oil cooler 6 into the tank 1*b* of the radiator, jigs for temporarily assembling the oil cooler 6 and those for temporarily attaching the oil cooler 6 to the radiator are not required. Therefore, an operation of removing the jigs need not be performed. The radiator can be assembled and transferred while the temporarily-assembled oil cooler 6 is accommodated in the tank 1*b,* and the oil cooler 6 and the radiator can be brazed together.

Accordingly, time and trouble required for temporarily assembling and brazing the oil-cooler-equipped radiator can be significantly reduced.

Furthermore, the blocking flange p1, which is in contact with the outer surface of the side wall of the tank 1*b* and which is wide enough to block the opening 1*c,* is integrally-formed in each of the connecting pipes P1 and P2, at a mid portion near the inserted side of the pipe on its outer surface. On the other hand, the diametrically opposed anchoring portions p2 project from the outer surface of each connecting pipe at the inserted-side end thereof. By engaging the anchoring portions p2 with each of the openings 8*c* of the tube plate 8*a,* the connecting pipes P1 and P2 are temporarily attached. The openings 8*c* of the tube plate 8*a* are long in the longitudinal direction of the tube plate 8*a* so that the anchoring portions p2 can pass therethrough. With this configuration, the connecting pipes P1 and P2 can be temporarily assembled to the tank 1*b* and the oil cooler 6 easily and quickly by a quick-fit method.

In addition, the width of each opening 1*c* in the side wall of the tank 1*b* is wider than at least the outer diameter of each of the connecting pipes P1 and P2 in the longitudinal direction of the oil cooler 6. Also, since the top portions of the both side pieces 12*b* of each holding plate 12 are disposed through the side wall of the tank 1*b* and are bent at the outer surface of the tank 1*b,* each circular interposed member 11 and the oil cooler 6 are sandwiched between the middle supporter pieces 12*a* of the holding plates 12 and the side wall of the tank 1*b* in the stacking direction of the element units 7, while the oil cooler 6 being movable in the longitudinal direction with respect to the side wall of the tank 1*b*. With this configuration, the connecting pipes P1 and P2 can relatively move freely at least in the longitudinal direction of the oil cooler 6 within the range of the large openings 1*c* in the side wall of the tank 1*b,* with respect to the side wall of the tank 1*b*. Therefore, thermal stress can be absorbed even if heat is hard to be transferred evenly to the oil cooler 6 in the tank 1*b* during a brazing process, causing difference in thermal expansion due to the temperature difference between the side wall of the tank 1*b* and the oil cooler 6 inside the tank 1*b*.

Consequently, deformation of the oil cooler 6 and/or a member such as the side wall of the tank 1*b* caused by heat treatment and occurrence of brazing failure can be prevented.

The embodiment of the present invention has been described above, but the specific configuration of the present invention is not limited to the above-described embodiment, and any design modification and so on without departing from the spirit of the present invention will be embraced in the present invention.

Figure 9:
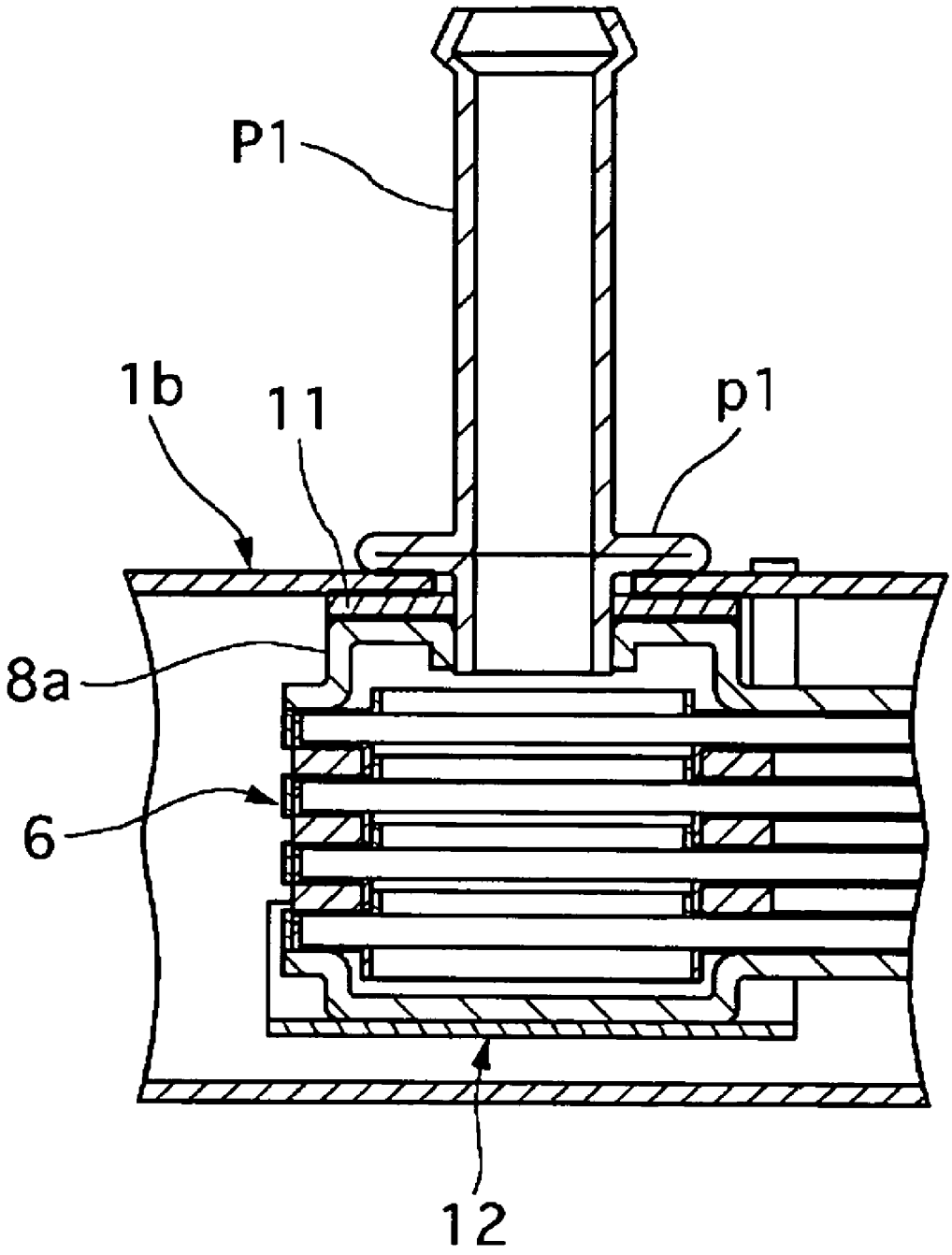
FIG. 9 illustrates an example of the temporary assembling structure of a connecting pipe.
Figure 10:
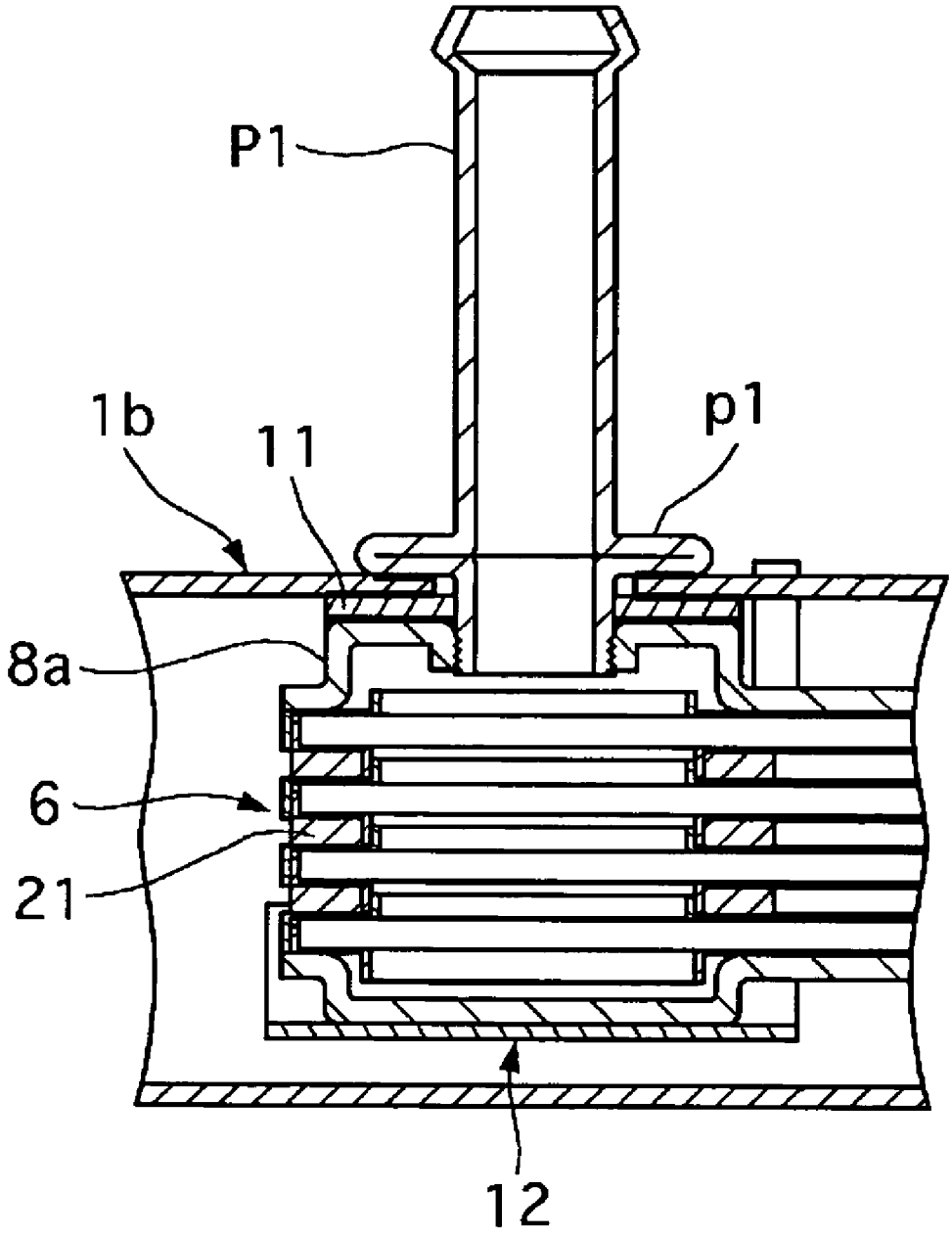
FIG. 10 illustrates another example of the temporary assembling structure of the connecting pipe.
Figure 11:
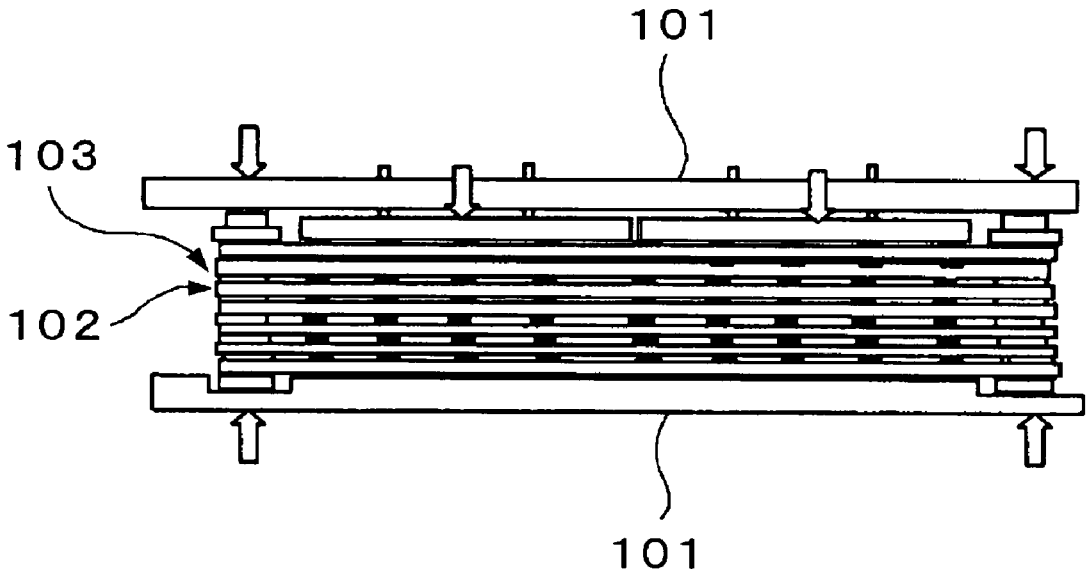
FIG. 11 PRIOR ART
FIG. 11 illustrates a prior art method of brazing of an oil-cooler-equipped radiator.

For example, in the embodiment, the connecting pipes P1 and P2 are temporarily assembled by engaging the anchoring portions p2 with the openings 8*c*. Alternatively, as shown in FIG. 9, a wall portion may be provided in each opening of the tube plate 8*a,* and the connecting pipes P1 and P2 may be press-fitted thereto. In addition, as shown in FIG. 10, the connecting pipes P1 and P2 may be screwed in the tube plate 8*a*.

In the above-described embodiments, the blocking flange p1 is integrally-formed in each of the connecting pipes P1 and P2. Alternatively, the blocking flange may be separately formed, and an anchoring protrusion for anchoring the blocking flange p1 may be provided in each of the connecting pipes P1 and P2.

The entire contents of Japanese Patent Application No. 2003-409279 filed Dec. 8, 2003 is incorporated herein by reference.

What is claimed is:

1. An oil-cooler-equipped radiator comprising:

a radiator;

a tank provided in the radiator; and an oil cooler that is accommodated in the tank of the radiator and that has a heat exchanger, the heat exchanger comprising:

a plurality of stacked element units that communicate with each other, a pair of fixed tube plates that are in communication with the outermost element units of the heat exchanger, and a pair of connecting pipes that are disposed through corresponding openings in a side wall of the tank and through corresponding openings in both end portions in the longitudinal direction of one of the tube plates, wherein each of the connecting pipes is formed with a blocking flange that is wide enough to block the corresponding opening of the tank and that is disposed on an outer surface of the corresponding connecting pipe at a mid portion of the corresponding connecting pipe such that the blocking flange is in contact with the outer surface of the side wall of the tank, wherein the width of each opening in the side wall of the tank is larger than at least the outer diameter of the corresponding connecting pipe in the longitudinal direction of the oil cooler, wherein, before brazing the oil-cooler-equipped radiator, which is brazed while the oil cooler is accommodated in the tank of the radiator in a state in which respective circular interposed members are correspondingly disposed between outer edge portions of the openings of the tube plate and inner edge portions of the openings of the tank, the connecting pipes are inserted through the corresponding openings of the tank so as to temporarily assemble the connecting pipes in the corresponding openings of the tube plate, so that both of the blocking flanges are retained while being in contact with the outer surface of the side wall of the and the oil cooler is held by holding plates each having bent portions so as to have a substantially U-shaped cross-section, and wherein top portions of side pieces of each holding plate are disposed through the side wall of the tank and are bent, so that the oil cooler is retained by being sandwiched between middle supporter pieces of the respective holding plates and the side wall of the tank in the stacking direction of the element units while being movable in the longitudinal direction of the oil cooler with respect to the side wall of the tank.

2. An oil-cooler-equipped radiator according to claim 1, wherein corresponding anchoring portions protrude from the outer surface of each of the connecting pipes at inserted-side ends of the connecting pipes, wherein each of the openings of the tube plate has a large-diameter portion so that the anchoring portions of the corresponding connecting pipe can pass therethrough, and wherein, by inserting the connecting pipes through the corresponding openings of the tank and rotating the connecting pipes about axes after the anchoring portions have passed through the large-diameter portions of the corresponding openings of the tube plate, the anchoring portions are engaged with inner edge portions of the corresponding openings of the tube plate, thereby temporarily assembling the connecting pipes in the corresponding openings of the tube plate.

3. A method of forming an oil-cooler-equipped radiator which is brazed while an oil cooler is accommodated in a tank of the radiator, the oil cooler being equipped with a heat exchanger that includes a plurality of stacked element units that communicate with each other; a pair of fixed tube plates that are in communication with the outermost element units of the heat exchanger; and a pair of connecting pipes that are disposed through corresponding openings in a side wall of the tank and through corresponding openings in both end portions in the longitudinal direction of one of the tube plates, the method comprising:

forming the width of each opening in the side wall of the tank to be larger than at least the outer diameter of the corresponding connecting pipe in the longitudinal direction of the oil cooler;

forming corresponding blocking flanges, each of which is wide enough to block the corresponding opening of the tank, on an outer surface of the corresponding connecting pipe at a mid portion of the corresponding pipe such that the blocking flange is in contact with the outer surface of the side wall of the tank;

inserting the connecting pipes into the corresponding openings of the tank so as to temporarily assemble the connecting pipes in the corresponding openings of the tube plate, so that both of the blocking flanges are retained while being in contact with the outer surface of the side wall of the tank;

holding the oil cooler with holding plates each having bent portions so as to have a substantially U-shaped cross-section;

disposing top portions of side pieces of each holding plate through the side wall of the tank;

bending the top portions so that the oil cooler is retained by being sandwiched between middle supporter pieces of the respective holding plates and the side wall of the tank in the stacking direction of the element units while being movable in the longitudinal direction of the oil cooler with respect to the side wall of the tank; and brazing the oil cooler and the tank in a state in which respective circular interposed members are correspondingly disposed between outer edge portions of the openings of the tube plate and inner edge portions of the openings of the tank.

* * * * *